US007114440B2

(12) United States Patent
Theilacker

(10) Patent No.: US 7,114,440 B2
(45) Date of Patent: Oct. 3, 2006

(54) METHOD FOR SETTING THE CUT REGISTER IN A WEB-FED ROTARY PRESS

(75) Inventor: Klaus Theilacker, Friedberg-Rederzhausen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 11/255,275

(22) Filed: Oct. 21, 2005

(65) Prior Publication Data

US 2006/0086276 A1 Apr. 27, 2006

(30) Foreign Application Priority Data

Oct. 23, 2004 (DE) ..... 10 2004 051 635

(51) Int. Cl.
*B41F 13/56* (2006.01)

(52) U.S. Cl. ..... 101/227; 101/226

(58) Field of Classification Search ..... 101/227, 101/224, 226, 228, 181, 248, 229, 211
See application file for complete search history.

(56) References Cited

U.S. PATENT DOCUMENTS 4,552,140 A * 11/1985 Cowley et al. ..... 128/201.25
4,722,275 A * 2/1988 Taguchi et al. ..... 101/228
5,052,296 A * 10/1991 Shiba ..... 101/227
5,119,725 A * 6/1992 Okamura ..... 101/226
5,123,316 A * 6/1992 Niedermaier et al. ..... 83/29
5,289,770 A * 3/1994 Hern ..... 101/226
5,438,926 A 8/1995 Hudyma et al. ..... 101/227
5,483,893 A * 1/1996 Isaac et al. ..... 101/485
6,321,650 B1 * 11/2001 Ogawa et al. ..... 101/227
6,532,872 B1 * 3/2003 Siegl et al. ..... 101/483
6,647,874 B1 * 11/2003 Siegl et al. ..... 101/211
6,748,857 B1 * 6/2004 Seiler et al. ..... 101/226
6,837,159 B1 * 1/2005 Elkotbi et al. ..... 101/219
6,955,122 B1 10/2005 Seiler et al. ..... 101/226
2003/0084765 A1 * 5/2003 Elkotbi et al. ..... 83/13

FOREIGN PATENT DOCUMENTS

DE 199 36 291 3/2001
EP 1 388 516 2/2004

* cited by examiner

*Primary Examiner*—Andrew H. Hirshfeld
*Assistant Examiner*—Wasseem H. Hamdan
(74) *Attorney, Agent, or Firm*—Cohen, Pontani, Lieberman & Pavane

(57) ABSTRACT

A method for setting the cut register in a web-fed rotary press includes assigning a cut register function to a predetermined speed function, wherein the predetermined speed function describes a time curve of an operating speed of the rotary press starting from a predetermined initial value and the cut register function describes a time curve of the set value of the cut register, and changing the set value of the cut register continuously and synchronously in accordance with the associated cut register function during a variation in the operating speed of the rotary press according to the predetermined speed function, the cut register function being chosen empirically such that it counteracts a change in the actual value of the cut position as a result of the change in the operating speed.

12 Claims, 4 Drawing Sheets

METHOD FOR SETTING THE CUT REGISTER IN A WEB-FED ROTARY PRESS

BACKGROUND OF THE INVENTION

The invention relates to a method for setting the cut register in a web-fed rotary press and to an apparatus for implementing the method.

DE 199 36 291 A1 describes a method for determining the cut positions of part webs of a longitudinally cut printing material web in a web-fed rotary press, in which the part webs are combined into strands, folded in a former and finally cross-cut by a knife cylinder. In this case, the cut individual webs are designated part webs and the combined part webs after the former are designated strands. The cut positions determined are used to regulate the cut register, a dedicated control loop being provided for each part web and, in addition, an outer control loop being provided for the strand already folded. In this way, it is intended to make it possible to keep the cut positions of all the part webs of the folded strand at a desired value in each case.

Such regulation with a cascade structure is complicated and, in particular, requires the use of a large number of sensors for registering the actual values of the cut position on the individual part webs and on the folded strand. This is not only costly but, as the number of sensors used rises, the probability of failure of the cut register regulation also increases, since failures of automated systems are generally caused to a predominant extent by sensor failures.

SUMMARY OF THE INVENTION

An object of the present invention is to provide a method for setting the cut register in a web-fed rotary press for minimizing the cut register error, that is to say the deviation of the cut position from a predefined desired value, in the most simple, cost-effective and reliable manner.

The object of the present invention is met by a method for setting the cut register in a web-fed rotary press, comprising the steps of assigning a cut register function to a predetermined speed function, wherein the predetermined speed function describes a time curve of an operating speed of the rotary press starting from a predetermined initial value and the cut register function describes a time curve of the set value of the cut register, and changing the set value of the cut register continuously and synchronously in accordance with the associated cut register function during a variation in the operating speed of the rotary press according to the predetermined speed function, the cut register function being chosen empirically such that it counteracts a change in the actual value of the cut position as a result of the change in the operating speed.

The object is also met by an apparatus for implementing the method comprising a memory storing a cut register function and a predetermined speed function, the predetermined speed function describes a time curve of an operating speed of the rotary press starting from a predetermined initial value and the cut register function describes a time curve of the set value of the cut register, an input interface to receive a signal derived from the operating speed of the press, an output interface to output at least one signal acting on the cut register setting of the press, and means for outputting at least one signal on said output interface that changes a set value of the cut register continuously and synchronously with said predetermined speed function in accordance with the associated cut register function if the signal applied to said input interface indicates a variation in the operating speed of the rotary press in accordance with the predetermined speed function.

The invention is based on the finding that, at a constant operating speed of a press, the cut position remains virtually constant and therefore, for a predefined speed, a sufficient accuracy of the cut position can already be achieved with a static setting of the cut register, that is to say without a control loop. However, in the event of speed changes, therefore in particular when running up from the setup speed to the continuous printing speed and when running back to the setup speed in the course of running down the printing operation, a comparatively large dynamic cut register error occurs. This dynamic cut register error has a characteristic time curve for a predefined time curve of the operating speed, which can be reproduced well with otherwise constant operating parameters of the press.

According to the present invention, therefore, a predetermined speed function, which describes a time curve of the operating speed of the press starting from a predetermined initial value, is assigned a cut register function which describes a time curve of the set value of the cut register. If the operating speed of the press varies according to the predetermined speed function, the set value of the cut register is changed continuously and synchronously in accordance with the associated cut register function. In this case, the cut register function is chosen empirically such that it counteracts a change in the actual value of the cut position as a result of the change in the operating speed.

Under the assumption that a press represents an approximately linear system in relation to the cut register, the cut register function used can be the negative value of a function which describes the time variation of the actual value of the cut position with respect to the value present at the predetermined initial value of the operating speed of the press for the case in which a variation in the operating speed is carried out in accordance with the predetermined speed function, keeping the set value of the cut register constant.

Such a function can be determined by measurements, for example by the operating speed being changed in accordance with the speed function of interest for the real operation and, in the process, the actual value of the cut position with a constant cut register setting being measured, either manually by using sample copies removed or by sensors using suitable marks on the printing material. For the purpose of simplification, a mathematical approximation function for the curve determined by measurement can then be used as a cut register function.

In a preferred embodiment, at least some of the parameters of such an approximation function are stored in a memory such that they can be indicated to the operator of the press and changed manually by the operator. This allows the operator to suitably adapt the cut register function given the occurrence of a drift of the cut position in the course of successive printing processes. The use of a mathematical approximation function, whose shape can be varied by a few adjustable parameters, is of great advantage from this point of view.

It is typical of the real printing operation that a variation in the operating speed does not run irregularly or randomly but that the time curve of the speed is subdivided into various characteristic sections. These sections are then also assigned characteristic sections of the cut register function.

In particular, a real speed function generally starts from a phase of constant initial speed, which is followed successively by a rise in the speed with a constant rate of rise, constancy of the speed over an interval of variable length but predetermined minimum length, and a fall in the speed at a constant rate of fall. A phase of constant final speed generally terminates the speed function.

In this case, the associated cut register function has a constant first value during the constant starting phase of the speed function. During the constant phase of higher speed, it reaches a constant second value. In the rise phase of the speed, it has a curved course, which can contain a maximum whose magnitude exceeds the constant second value. This results from a characteristic peak in the cut register error, which is to be observed in the case of a linear rise in the speed in the case of a constant cut register setting.

The cut register function belonging to the speed function previously described, which has a constant first value during the constant starting phase of the speed function, not only reaches a constant second value during the constant phase of higher speed but also a constant third value during the constant end phase of the speed. In the phase of falling speed between the constant second value and the constant third value, it then runs approximately linearly.

If a press has a number of setting elements for cut register setting, as is the case in newspaper presses, in which a number of webs printed simultaneously are combined to form a single product, then each of these setting elements can be assigned an individual cut register function, to compensate for different effects of a speed change of the machine as a result of different web guidance and path lengths of the individual webs or the part webs or strands produced therefrom by longitudinal cutting and folding within the context of what is possible.

In order to implement the method according to the invention, an apparatus is needed which has a memory for storing at least one cut register function and an input interface to receive a signal derived from the operating speed of the press, and also an output interface to output at least one signal acting on the cut register setting of the press. If the signal applied to the input interface indicates a variation in the operating speed of the press in accordance with a predetermined speed function to which the cut register function is assigned, the apparatus outputs at least one signal which changes the set value of the cut register continuously and synchronously with the speed function in accordance with the associated cut register function.

In order to permit simple manual adaptation of the course of the cut register function, this should be stored in the memory in the form of a mathematical approximation function for a function determined by measurements, and an indicating unit for indicating at least some of the parameters of the approximation function and an input unit for changing the parameters manually will be needed.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
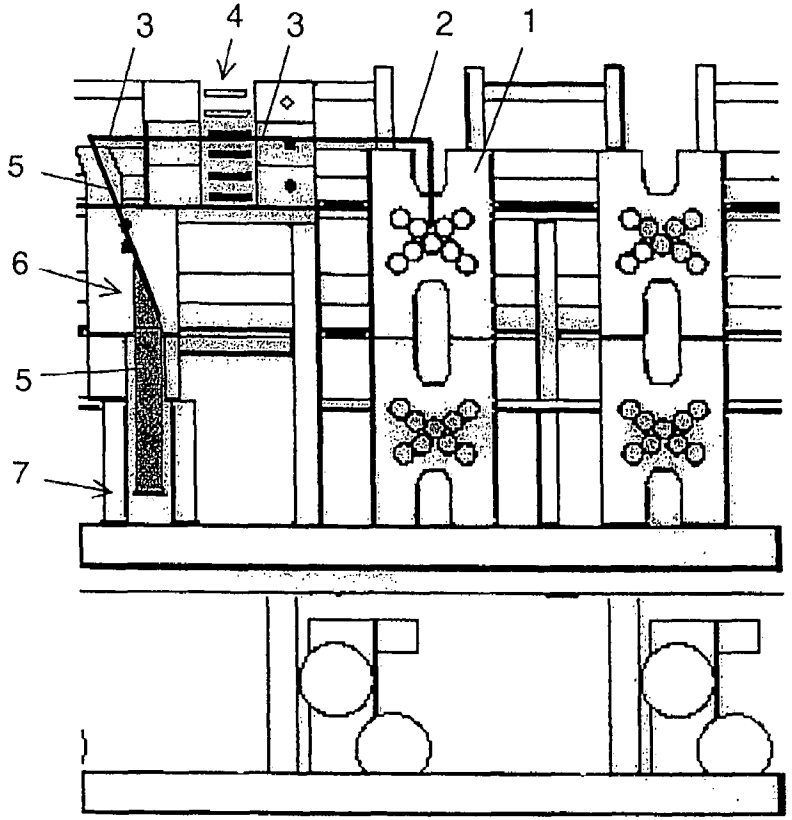
FIG. 1 is a schematic side view of a press having two printing units.

First of all, by using FIG. 1, a short overview of the path of a printing material through a press is to be given, to the extent to which it is important to the present invention. As FIG. 1 shows, a press normally has a plurality of printing units, in which a printing material web is printed in each case. In FIG. 1, for the purpose of simplification, only the web 2 printed in the printing unit 1 is illustrated after it leaves the printing unit 1.

This web 2, like the webs coming from the other printing units, is firstly cut longitudinally into two part webs 3. Of the part webs 3, one is turned in a turner unit 4 before the two part webs 3 are combined with part webs, not illustrated, coming from other printing units to form a strand 5 and the latter is folded at a former 6. As a result of the folding at the former 6, the strand 5 is rotated through 90° and then runs to a knife cylinder 7, where it is crosscut into individual sections. In the process, the position of the cut must be coordinated with the position of the printed image, to maintain a constant, predetermined spacing of the printed image from the cut edges in the longitudinal direction.

In order to set the cut register, that is to say the cut position in relation to the printed image, the web 2 or the part webs 3 and also, if appropriate, additionally the strand 5, can be guided over rolls that can be displaced linearly transversely with respect to the transport direction, with the aid of which the path length to be covered from the printing unit 1 as far as the knife cylinder 7 can be varied specifically. Another possibility is to adjust the rotational speed of the impression cylinders of the printing unit 1 to displace the printed image with respect to the cut position with a constant path length from the printing unit 1 to the knife cylinder 7. The latter has the advantage that no additional actuating elements for the cut register are needed. However, the applicability of the method according to the invention does not depend on the type of actuating elements with which the cut register setting is implemented.

If no closed control loop with appropriate sensors along the path from the printing units 1 to the knife cylinder 7 is provided, then the cut register is set manually by the operator of the press during the setting up off the machine for the printing operation, for which purpose measurements are normally made on sample copies of the finished printed product. The cut register setting is changed in the appropriate direction until the desired cut position is achieved.

In setup operation, a press normally runs at a relatively low speed, in order to keep the accumulation of waste low. Once the machine has been set up, then the speed is increased up to the continuous printing speed of the machine, it not being possible for this increase to be carried out abruptly but continuously with a normally constant rate of rise predefined permanently by the electronic control system of the machine. This time curve of the operating speed of a press is reproduced in FIG. 2 by the dashed curve 8, the phase of constant setup speed being identified by A and the phase of linear increase in speed being identified by B. The scaling of the two axes is linear in FIG. 2.

Figure 2:
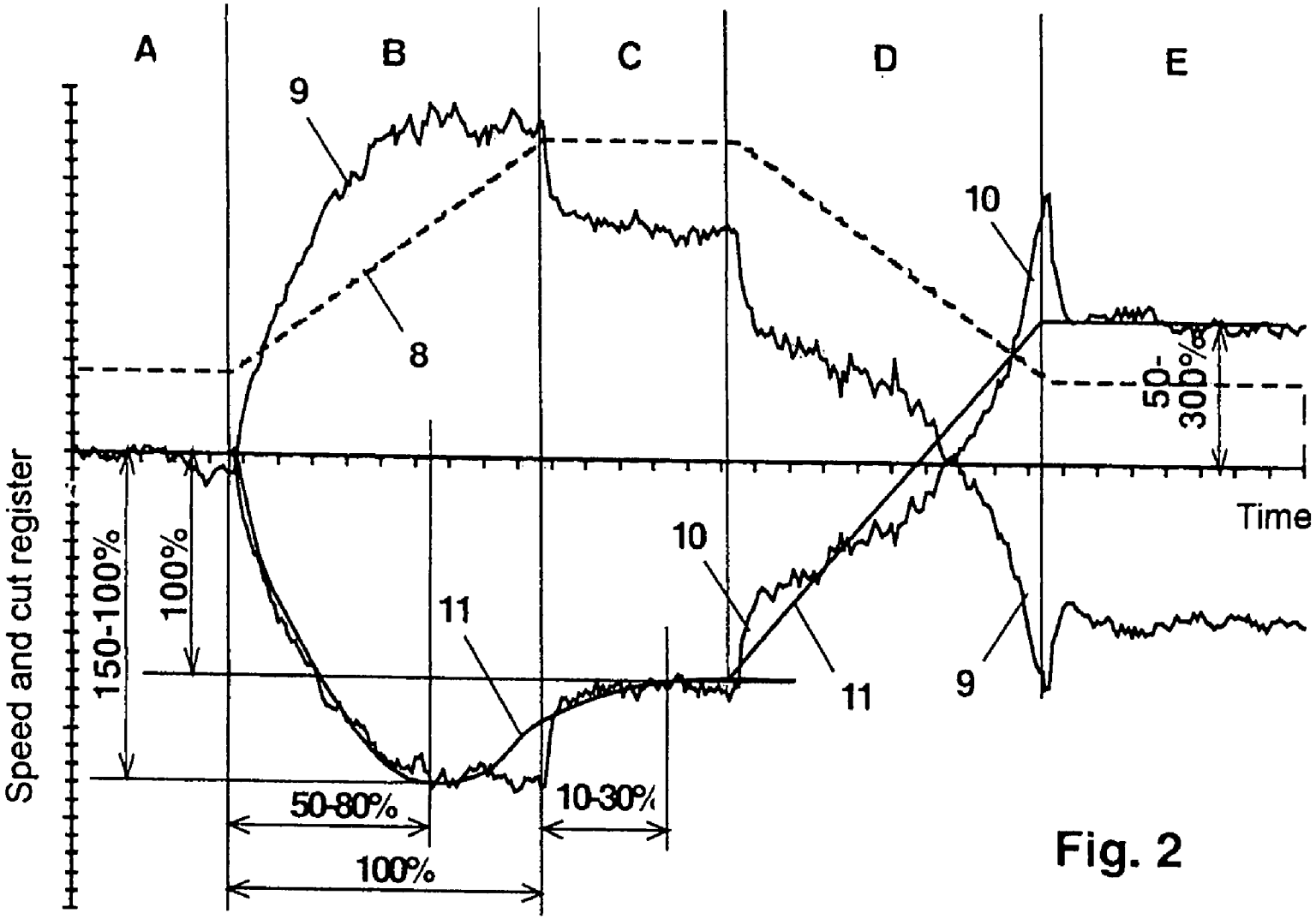
FIG. 2 is a time curve of the operating speed, of the cut register error and of the cut register setting.

Once the continuous printing speed has been reached, it is maintained in a phase C until an envisaged number of printed products has been produced. In FIG. 2, this phase is illustrated as highly shortened as compared with the real printing operation. Finally, in a phase D, the speed is again reduced at a constant rate of fall predefined permanently by the electronic control system of the machine until a predefined final speed, which normally corresponds to the setup speed, and therefore the last operating phase E is reached.

If the cut register setting is made at the setup speed and is then maintained during the variation of the speed during the phases B to E described above, the result is a cut register error, that is to say a deviation of the cut position from its desired value, as shown by the curve 9 in FIG. 2. The scaling in FIG. 2 is also linear with respect to the cut register.

As long as the setup speed has not yet been left, the cut register error is virtually zero. That is, in phase A, only slight fluctuations of the curve 9 close to the zero position can be determined. During the rise of the speed in phase B, the cut register error rises sharply, its time curve being distinctly nonlinear and being flattened distinctly with increasing rise period, in spite of a constant rate of rise of the speed.

At the transition of the speed rise into the phase C of constant continuous printing speed, the cut register error falls virtually abruptly by a certain amount below the value reached at the end of phase B and then remains virtually constant during phase C, apart from slight fluctuations which are comparable with those of phase A. As mentioned previously, phase C is illustrated as highly shortened in FIG. 2, although, in view of the approximate constancy of the cut register error in this phase, it plays no role in the understanding of the invention.

If the speed is reduced with a constant rate of fall in phase D, starting from the constant value of phase C, then the cut register error likewise falls but by no means inversely in relation to its course during the speed rise but substantially more quickly. Even the zero line is undershot and, at the end of phase D, the cut register error reaches a negative value which, in terms of amplitude, is of the same order of magnitude as the approximately constant positive value in phase C. To a first approximation, the course of the cut register error in phase D can be viewed as linear.

When the speed has reached its end value and is kept constant again in phase E, then initially an abrupt reversal of the magnitude of the cut register error is to be observed, which then again remains virtually constant at a value which is now negative. This applies even if the end speed corresponds to the initial speed. The press is therefore a time-variant system in relation to the cut register error.

The present invention is based on the fact that the cut register error which was set to the value zero by the operator of the machine in phase A can be compensated for, i.e. can be kept approximately at the value zero, in that, during the passage through a predefined time curve of the machine speed, the cut register setting is varied deliberately, to be specific in accordance with the negative value of the previously empirically determined curve 9. This mirroring of the curve 9 on the time axis is illustrated in FIG. 2 as curve 10.

Since the curve 9 is doubtless subject to certain stochastic fluctuations, it would not be practical to use the negative measured curve 10 actually to compensate for the cut register error. Instead, the curve 10 can be described relatively accurately by a mathematical approximation function. It must likewise be possible for this approximation function to be defined in clearly distinguishable sections in accordance with the subdivision of curves 8 and 9.

In FIG. 2, such an approximation function is drawn in by way of example as curve 11. This approximation function 11 is equal to zero in phase A, has a curved course in phase B and at the start of phase C, which has a maximum in terms of magnitude within phase B. It can in each case be approximated with good accuracy by, for example, a cubic polynomial. In the course of phase C, it changes to a constant value which, in the real printing operation, lasts for a relatively long time as compared with the curved initial region of this phase. In phase D, the approximation function runs linearly, changing its sign. At the start of phase E, it changes to a constant value again, which is maintained as long as necessary.

In FIG. 2, purely by way of example, some guide values for parameters for characterizing the curve 11 are indicated. For example, the time period from the start of phase B to the maximum of the magnitude is about 50–80% of the total duration of phase B. The transition region at the start of phase C until a constant value is reached is about 10–30% of the length of phase B. The height of the maximum of the magnitude in phase B is around 100–150% of the constant value reached in the course of phase C. The height of the constant end value with inverse sign in phase E has a magnitude in the range from 50–300% of the constant value reached in the course of phase C. The range in which the slope of the curve 11 lies within phase D results in a clear manner from the remaining parameters.

Figure 3:
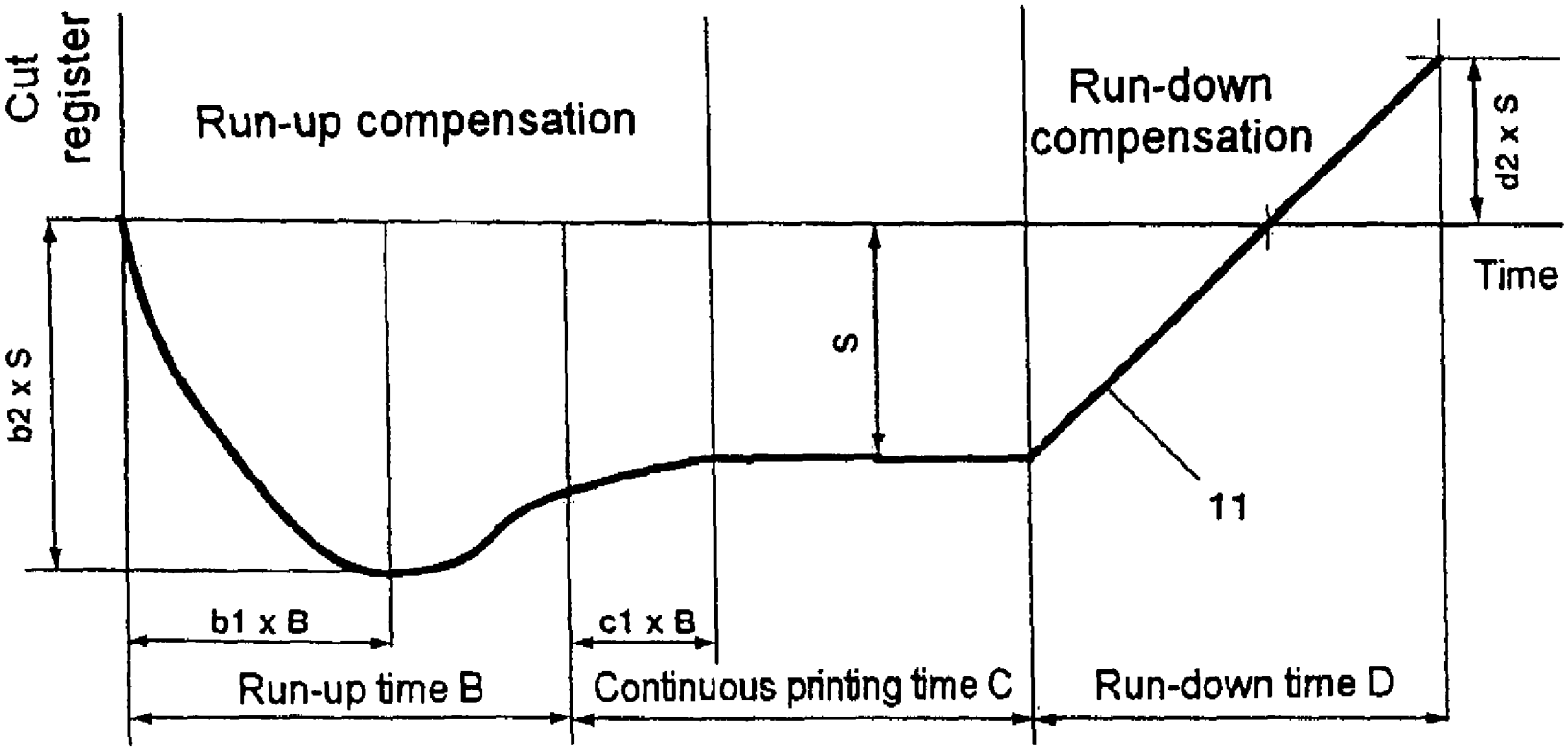
FIG. 3 is a time curve of the cut register setting in the form of an approximation curve.

For the purpose of illustration, the compensation curve 11 for the phases of running up B, of continuous printing C and running down D are illustrated once more on their own in FIG. 3. If the basic course of the curve is fixed in the form of a function defined section by section by using compensation polynomials for the phase B and the initial region of phase C and the straight line portions for the remaining region of phase C and phase D, then the compensation curve 11 can be described completely by a total of five parameters. These are the position of the maximum of the magnitude in phase B as a proportion b1 of the total run-up time B, the duration of the transition in phase C as a proportion c1 of the total continuous printing time C, the value S of the cut register setting in the steady-state region of the continuous printing time C, the ratio b2 of the height of the maximum of the magnitude of the cut register setting in phase B to the value S, and also the ratio d2 of the end value of the cut register setting at the end of phase D to the value S. In this case, $b2 \geqq 1$ and $d2 < 0$.

It should be noted that, for the purpose of the mathematical description of the compensation curve 11, a total of more than the aforementioned parameters are needed if phase B and the initial region of phase C are represented, for example, by two cubic polynomials. The adaptation of all the curve parameters, that is to say all the polynomial coefficients in the case of polynomials, to the aforementioned settable parameters can, however, be carried out automatically by the control device of the press in accordance with predefined mathematical rules.

If, by means of control measurements during printing operation, the printer establishes that the compensation action is inadequate in one or more phases, that is to say that, in the case in which the compensation curve 11 predefined at the start of printing operation, an impermissibly large cut register error occurs, then he can change one or more of the parameters b1, c1, S, b2 and d2 by manual intervention. This change acts directly on the current printing operation and is stored for the next run of the press as a new shape of the compensation curve 11. In this way, the shape of the compensation curve 11 can be made to track slow time changes in the behaviour of the press if required, that is to say the long-term drift of the dynamic cut register error.

It goes without saying that the duration of the setup phase A and the duration of the end phase E are arbitrary, since the compensation only begins with the entry to phase B and, after the end of phase D, the cut register setting d2×S reached there is no longer changed.

The preceding courses of the curves shown in FIGS. 2 and 3 should be understood as purely exemplary. In particular, the course of the dynamic cut register error in the case of a given course of the operating speed depends on the individual press, and also on the printing material and the web path lengths. In this case, not only are quantitative differences in the values of the characteristic parameters possible but also qualitative differences, that is to say a shape of the necessary compensation curve 11 which deviates considerably from the course shown as an example. In any case, however, it can be assumed that the shape of the curve 9 of the cut register error for a given speed curve 8 is a reproducible characteristic of the respective press and of the printing material used, and that it can generally be described sufficiently accurately by an approximation function 11 defined section by section.

The method according to the invention can also be applied when a press is to be operated as desired with various rates of rise and fall of the speed and/or with various continuous printing speeds. In this case, an associated compensation function 11 must be stored for every possible speed curve 8, or that present must be expanded differently with the factors b1, b2, c1, d2.

Figure 4:
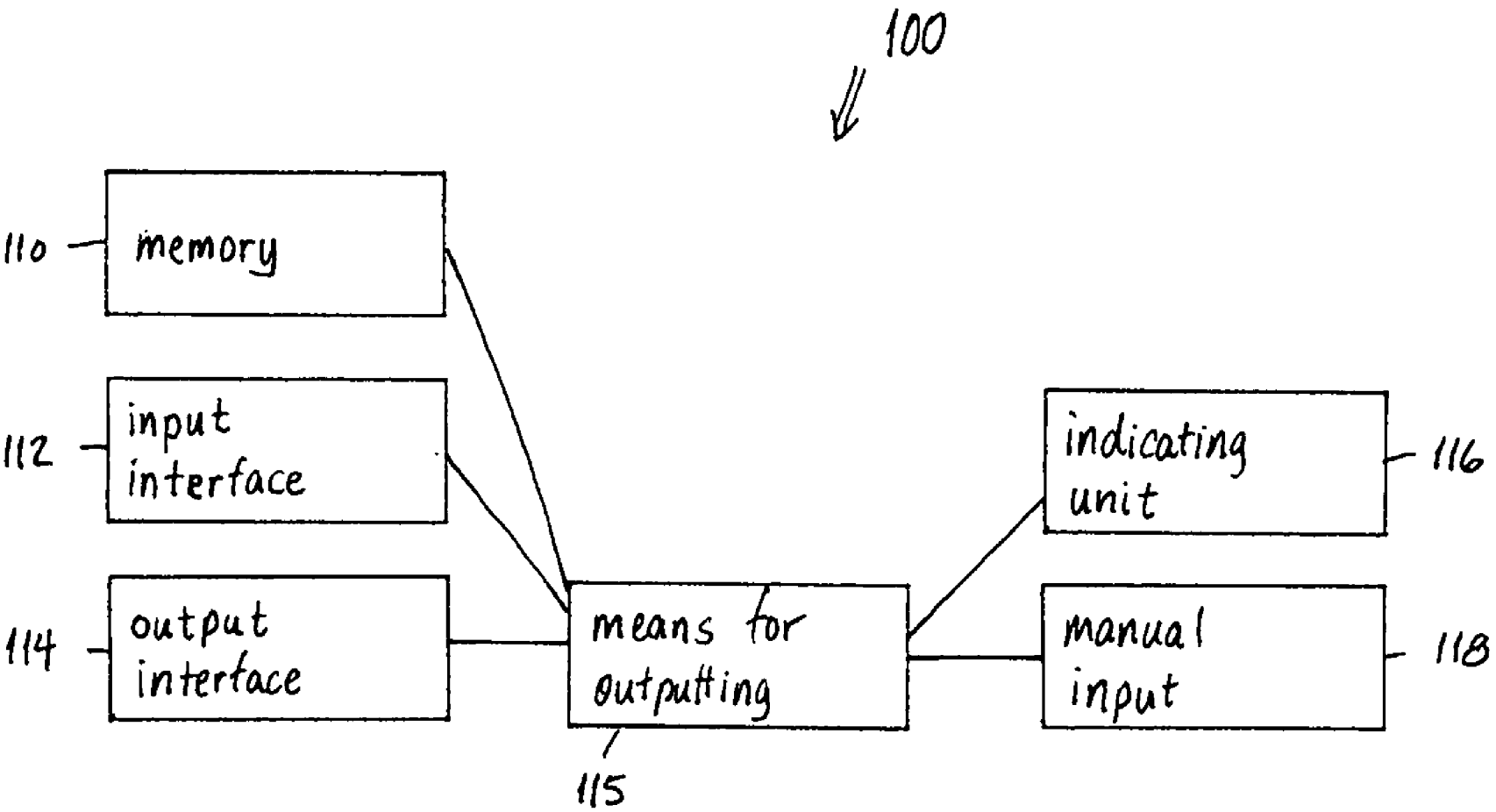
FIG. 4 is a block diagram of a control system for the present invention.

It is advantageous that the method according to the invention can be implemented with only little expenditure on apparatus. For example, FIG. 4 shows the control system 100 of the press for the setting of the cut register merely has to have a memory 110 for the cut register function 11, suitable input interface 112 to receive a speed signal and a suitable output interface 114 to output a cut register actuating signal. Since a cut register function 11 is valid only for a single speed function 8, in this case the speed signal has to indicate only the beginning of phase B and the beginning of phase D, since only these two times are variable. An outputting means 115 outputs at least one signal on said output interface that changes a set value of the cut register continuously and synchronously with the predetermined speed function in accordance with the associated cut register function, if the signal applied to the input interface 112 indicates a variation in the operating speed of the rotary press in accordance with the predetermined speed function. The effort for the modification of a conventional cut register control system in the spirit of the invention is low and lies predominantly in the area of programming.

As mentioned above, the cut register function may be described sufficiently accurately by an approximation function. The control system 100 also includes an indicating unit 116 for indicating at least some of the parameters of the approximation function to an operator of the rotary press and a manual input unit 118 for receiving manual commands for changing the parameters of the approximation function from the operator.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for setting the cut register in a web-fed rotary press, comprising the steps of:

assigning a cut register function to a predetermined speed function, wherein the predetermined speed function describes a time curve of an operating speed of the rotary press starting from a predetermined initial value and the cut register function describes a time curve of the set value of the cut register; and changing the set value of the cut register continuously and synchronously in accordance with the associated cut register function during a variation in the operating speed of the rotary press according to the predetermined speed function, the cut register function being chosen empirically such that it counteracts a change in the actual value of the cut position as a result of the change in the operating speed.

2. The method of claim 1, wherein the cut register function used in said step of changing is a negative value of a function which describes the time variation of the actual value of the cut position with respect to the value present at the predetermined initial value of the operating speed of the press during a variation in the operating speed in accordance with the predetermined speed function, thereby keeping the set value of the cut register constant.

3. The method of claim 2, wherein the cut register function is a mathematical approximation function for the negative value of a function which describes the time variation of the actual value of the cut position.

4. The method of claim 3, further comprising the step of storing at least some parameters of the approximation function in a memory such that the stored parameters are indicated to an operator and are manually changeable by the operator.

5. The method of claim 1, wherein the predetermined speed function is subdivided into a plurality of characteristic sections, said step of assigning includes assigning each of the characteristic sections of the predetermined speed function to a respective characteristic section of the cut register function.

6. The method of claim 5, wherein the predetermined speed function starts from a first section A of a constant initial speed, contains successively a second section B including a rise in the speed with a constant rate of rise, a third section C having a constancy of the speed over an interval of variable length but predetermined minimum length, a fourth section D having a fall in the speed at a constant rate of fall, and terminates with a fifth section E of constant final speed.

7. The method of claim 6, wherein the cut register function has a constant first value during the first section A of the speed function, the cut register function reaches a constant second value during the third section C, and the cut register function includes a course containing a maximum whose magnitude exceeds the constant second value in the second section B of the predetermined speed function.

8. The method of claim 6, wherein the cut register function has a constant first value during the first section A of the speed function, reaches a constant second value during the third section C, reaches a constant third value during the fifth section E, and runs approximately linearly in the fourth section D.

9. The method of claim 1, further comprising the step of assigning an individual cut register function for each setting element in the rotary press provided for setting the cut register.

10. An apparatus for setting the cut register in a web-fed rotary press, comprising:

a memory storing a cut register function and a predetermined speed function, the predetermined speed function describes a time curve of an operating speed of the rotary press starting from a predetermined initial value and the cut register function describes a time curve of the set value of the cut register;

an input interface to receive a signal derived from the operating speed of the press;

an output interface to output at least one signal acting on the cut register setting of the press; and means for outputting at least one signal on said output interface that changes a set value of the cut register continuously and synchronously with said predetermined speed function in accordance with the associated cut register function if the signal applied to said input interface indicates a variation in the operating speed of the rotary press in accordance with the predetermined speed function.

11. The apparatus of claim 10, wherein the cut register function is a mathematical approximation function for a function determined by measurements.

12. The apparatus of claim 11, further comprising an indicating unit for indicating at least some of the parameters of the approximation function to an operator of the rotary press and an input unit for receiving manual commands for changing the parameters of the approximation function.

* * * * *